United States Patent [19]

Spear et al.

[11] 4,240,522

[45] Dec. 23, 1980

[54] EXTENSION TRESTLE LADDER

[75] Inventors: Kenneth J. Spear, Sharon; Donald L. Shawkey, Sandy Lake, both of Pa.

[73] Assignee: R. D. Werner Co., Inc., Greenville, Pa.

[21] Appl. No.: 968,210

[22] Filed: Dec. 11, 1978

[51] Int. Cl.[3] ..... E04G 1/30; E06C 1/18

[52] U.S. Cl. ..... 182/105; 182/182

[58] Field of Search ..... 182/105, 182, 209-213, 182/166, 227

[56] References Cited

U.S. PATENT DOCUMENTS

| | | | |
|---|---|---|---|
| 838,831 | 12/1906 | Wilson | 182/166 |
| 947,810 | 2/1910 | Glidden | 182/105 |
| 1,140,390 | 5/1915 | Moulton | 182/105 |
| 2,144,440 | 1/1939 | Gaffers | 182/105 |
| 2,210,803 | 8/1940 | Dunn | 182/213 |

*Primary Examiner*—Reinaldo P. Machado

*Attorney, Agent, or Firm*—J. Helen Slough

[57] ABSTRACT

A device for automatically locking the fly assembly of an extension trestle ladder in an extended or lowered adjustment position. The fly assembly is supported to prevent downward movement by a displaceable member which abuts a rung on the fly assembly along a portion of the length of the rung, which member is spring biased for automatic return to locking position.

4 Claims, 8 Drawing Figures

EXTENSION TRESTLE LADDER

This invention relates to extension trestle ladders, and in particular to devices for automatically locking the fly assembly of an extension trestle ladder in a number of selectable extended and lowered adjustment positions.

Extension trestle ladders are well known in the art. Such ladders generally comprise an A-frame trestle and a fly assembly. The A-frame trestle comprises two mutually supporting ladders. The fly assembly is a ladder movably attached intermediate the two ladder sections of the A-frame. The fly assembly may be adjusted to an extended position to give added height to the trestle ladder or it may be adjusted to a lowered position for storage. The A-frame trestle provides a stable support for extending the fly assembly.

A continuing problem in such extension trestle ladders is to find a secure but convenient means for safely locking the fly assembly in an extended or lowered adjusted position which requires only a minimum amount of manipulation by the ladder operator.

One type of prior art extension trestle ladder uses a fly retainer which is manually operated and which is mounted on one of the supporting trestle ladders for receiving end portions of rungs on the fly assembly. There are other extension trestle ladders known in the prior art which employ gravity operated locks on opposite sides of the trestle which engage opposite ends of rungs on the fly assembly.

It is an object of this invention to provide a device for safely locking a fly assembly of an extension trestle ladder in an extended or lowered adjustment position.

It is another object of this invention to provide a device for securely locking a fly assembly of an extension trestle ladder with support of a substantial portion of a selected rung on the fly assembly.

Still another object of this invention is to provide a means for locking the fly assembly of an extension trestle ladder which requires a minimum amount of manipulation by the operator.

It is yet another object of this invention to provide a means for locking the fly assembly of an extension trestle ladder which allows extension of the fly assembly but which automatically locks to prevent contracting of the fly assembly.

Figure 1:
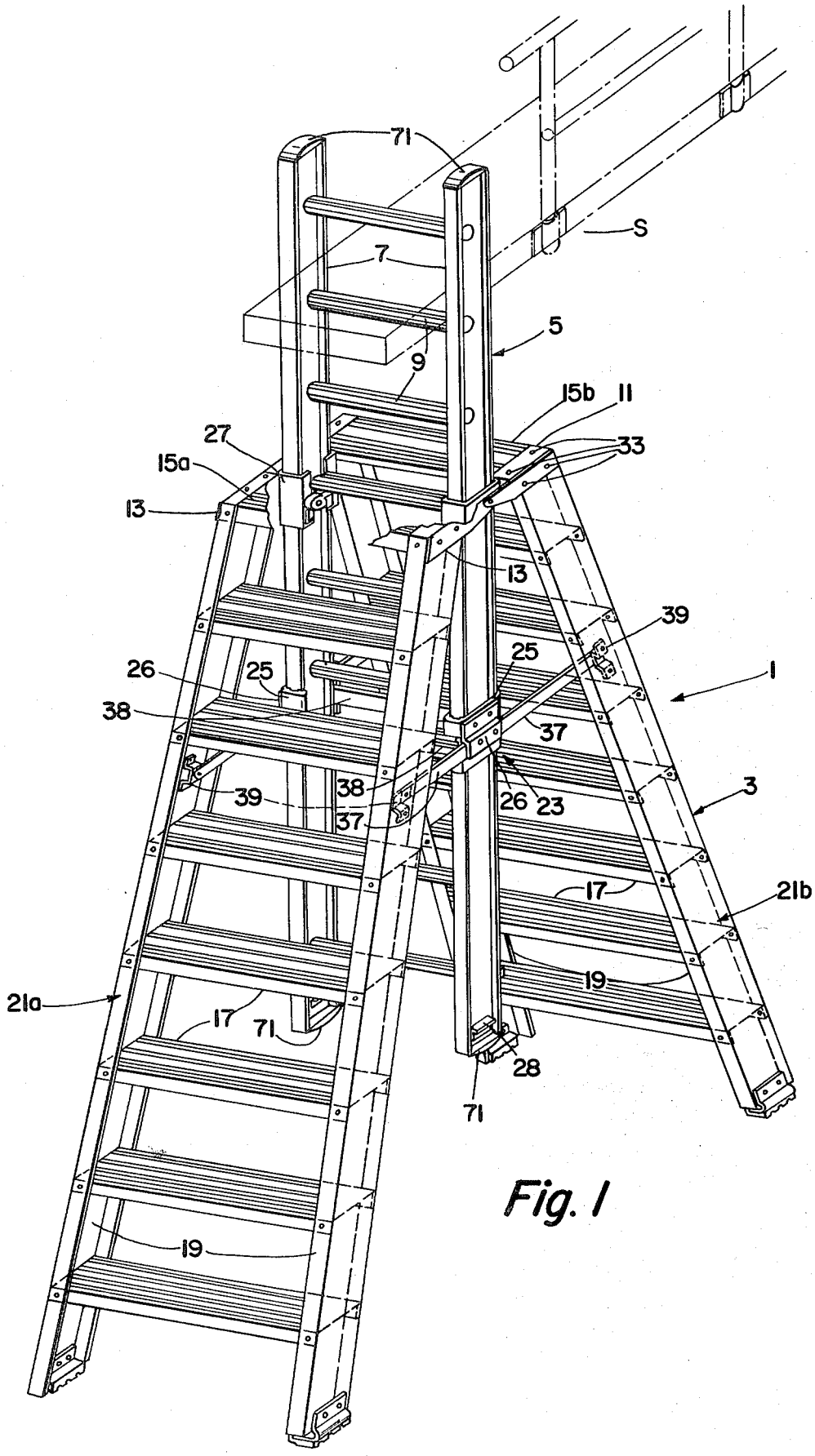
Figure 2A:
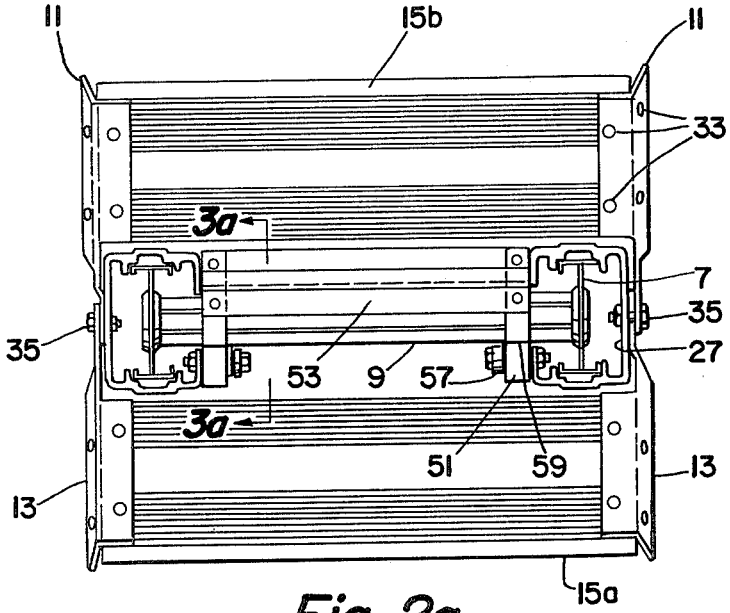
Figure 3A:
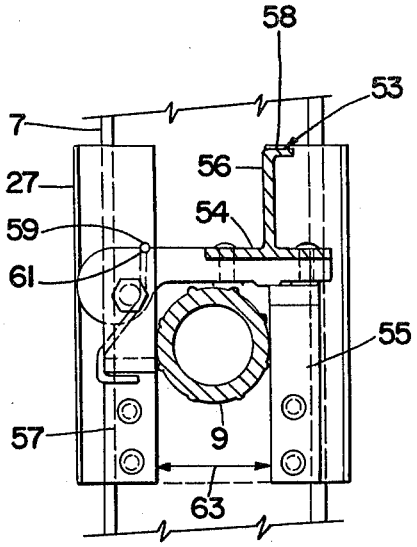
Figure 2B:
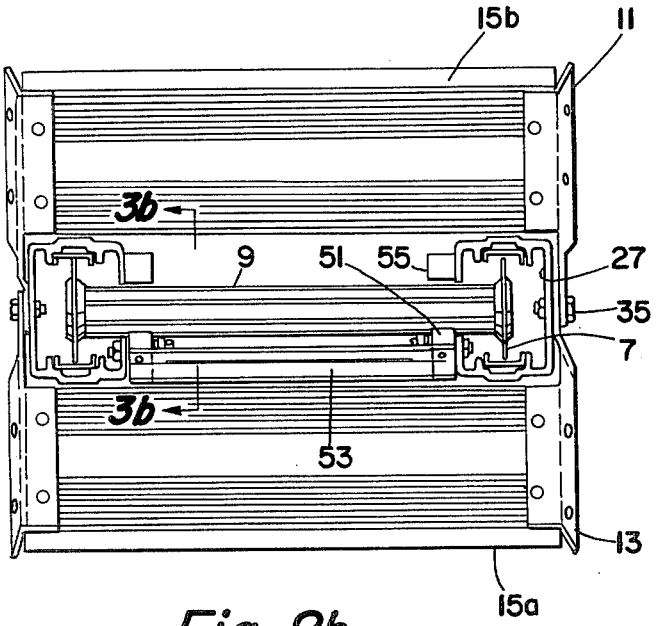
Figure 3B:
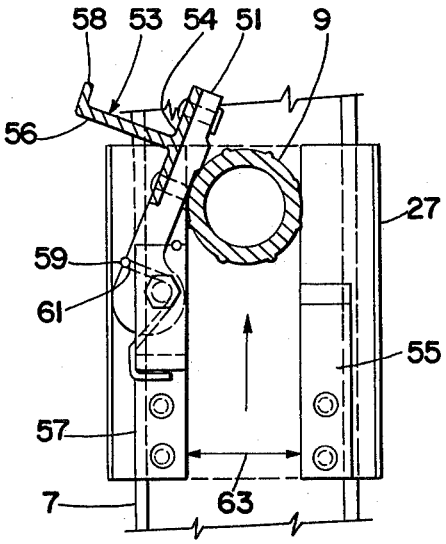
Figure 2C:
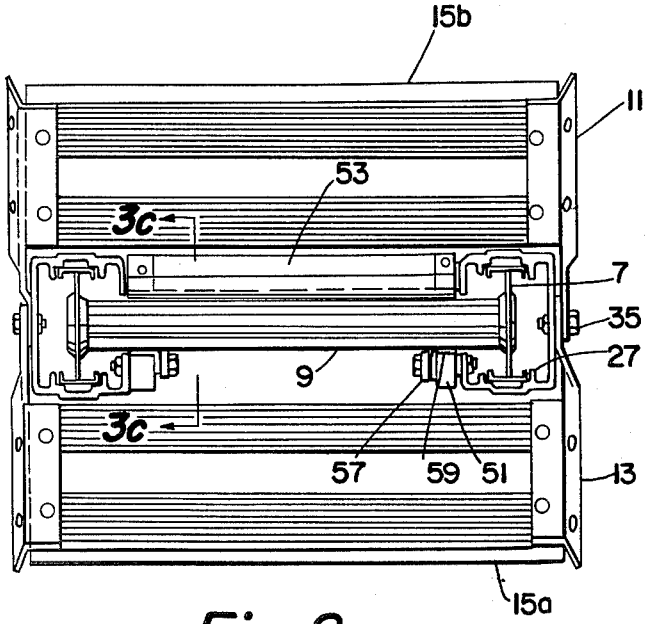
Figure 3C:
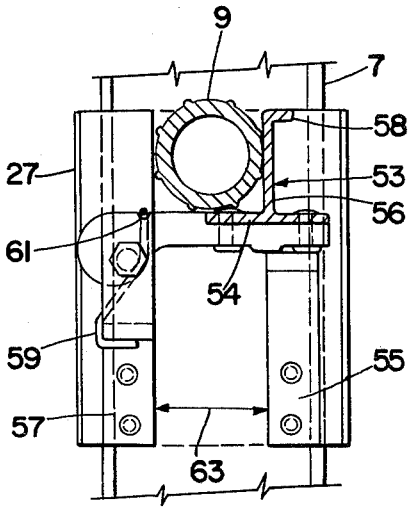
Figure 4:
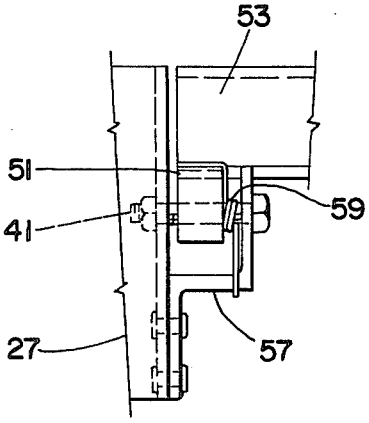

Other objects will become apparent to those skilled in the art to which the invention pertains and from the following description and appended claims, taken in conjunction with the figures of drawing wherein:

FIG. 1 is a perspective view of an extension trestle ladder partially cut away to show a lock according to the invention, the ladder shown supporting the end of a scaffold section in phantom lines;

FIG. 2*a* is a fragmentary top plan view of an extension trestle ladder incorporating a lock in accordance with the present invention, with the lock shown contacting the top surface of a rung in the fly assembly as the assembly is raised;

FIG. 2*b* is a fragmentary top plan view similar to FIG. 2*a*, showing the lock in a displaced configuration as the fly assembly is further raised fom the position shown in FIG. 2*a*;

FIG. 2*c* is a fragmentary top plan view similar to FIG. 2*a*, showing the lock in a supporting position abutting the rung of the fly assembly;

FIG. 3*a* is a fragmentary sectional view taken substantially along the line 3*a*—3*a* of FIG. 2*a*;

FIG. 3*b* is a fragmentary sectional view taken substantially along the line 3*b*—3*b* of FIG. 2*b*;

FIG. 3*c* is a fragmentary sectional view taken substantially along the line 3*c*—3*c* of FIG. 2*c*; and FIG. 4 is a partial side view showing a portion of a lock according to the invention.

Referring now to the drawings, in all of which like parts are designated by like reference characters, in FIG. 1 we show an extension trestle ladder with the fly assembly secured in an extended adjustment position by a lock according to the invention, and showing its use as a support for one end of a scaffolding platform S. The top of the extension ladder is shown in greater detail in FIGS. 2*a*, 2*b*, and 2*c*. The extension trestle ladder 1 comprises an A-frame 3 and a fly assembly 5. The fly assembly is a ladder made from two side rails 7 and a plurality of rungs 9 interconnecting the side rails. The A-frame trestle 3 is constructed from a pair of supporting ladders 21*a*, 21*b*. Each supporting ladder of the A-frame trestle comprises a pair of side rails 19 and has a plurality of rungs or steps 17. Each supporting ladder 21*a*, 21*b* terminates at a top step 15*a*, 15*b*, respectively.

The supporting ladders are joined in hinged relationship at the top of each ladder by bolts or other fastening means. A pair of top angle brackets 11 are secured by rivets 33 to the tops of opposite side rails of supporting ladder 21*b* and to the top step 15*b*. Similarly, a pair of slightly offset top angle brackets 13 are secured by rivets to the tops of opposite side rails of supporting ladder 21*a* and to the top step 15*a*. The top angle brackets 11 and offset top angle brackets 13 on corresponding sides are secured by a single bolt and nut assembly 35 or similar fastening means which can preferably also serve as axle means for rotation of the ladder 21*a* and 21*b* between open and collapsed configurations.

A spreader assembly 23 is disposed between the two support ladders on each side of the A-frame trestle. Each spreader assembly comprises a pair of spreader bars 37 which are secured to side rails of each support ladder by pivotally attaching, such as by bolting, the ends of the spreader bars to a corresponding pivot bracket 39 riveted to each side rail, as best viewed in FIG. 1. The other ends of the spreader bars are pivotally attached, such as by riveting, to a lower guide bracket sleeve 25. The upper portion of a center link stop bracket 26 is securely fastened, such as by two rivets, to the lower guide bracket sleeve 25. The lower portion of the center link stop bracket 26 is outwardly offset from the lower guide bracket sleeve 25, and the spreader bars 37 are received in the space between the center link stop and the lower guide bracket sleeve. Preferably the rivets attaching the spreader arms 37 to the lower guide bracket sleeve 25 also attach the spreader arms to the lower portion of the center link stop bracket 26. The spreader assembly 23 prevents the supporting ladders 21*a*, 21*b* from spreading too far apart when the extension ladder is open. Yet, the spreader assembly also allows the A-frame trestle to close into a more compact position with the lower guide bracket sleeve 25 riding upward as the spreader arms 37 pivot. The upper portion of the center link stop bracket 26 limits the range of pivoting of the spreader arms 37 about their points of attachment to the lower guide bracket sleeve 25 so that when the extension ladder is open the lower guide bracket sleeve does not fall below a level roughly even with the pivot brackets 39 on the supporting ladders. Tie bars 38 connect the two lower guide brackets 25. One tie bar 38 is on each side of the fly assembly 5 and does not interfere the movements of the fly assembly described below. The tie bars 38 render each spreader assembly 23 more stable and also coordinate the movements of the two spreader assemblies.

An upper guide bracket sleeve 27 is mounted on each side of the A-frame trestle by securing it to same bolt 35 which secures the top angle bracket 11 and offset top angle bracket 13. The side rails of the fly assembly are received in channels in the lower and the upper guide bracket sleeves. The side rails of the fly assembly are free to move up and down through these channels, but the side rails are restrained from forward, backward, and sideways movement by the guide bracket sleeves. The inner sides of the lower and upper guide bracket sleeves have openings 63 which allow passage of the rungs of the fly assembly as the fly assembly moves up and down. Preferably the width of each opening 63 is only slightly greater than the diameter of any rung on the fly assembly. The extending and lowering of the fly assembly may be readily described as upward and downward movements, respectively, through a vertical plane. This vertical plane passes through the longitudinal axes of the rungs on the fly assembly and through the A-frame trestle most preferably by bisecting the trestle at the points where the support ladders are pivotally attached, which points correspond to the placement of bolts 35 in the drawings. The upper and lower guide bracket sleeves are dimensioned to substantially confine movement of the fly assembly in this plane, whereby stability is enhanced.

A pair of stop brackets 28 disposed outwardly at the lowermost ends of the side rails 7 prevent the fly assembly 5 from being pulled entirely up through the lower guide bracket sleeves 25. However, if the fly assembly is disengaged from the locking device as described below, and if the extension trestle ladder is laid on its side, the fly assembly may be pulled all the way out of the lower and upper guide bracket sleeves. When so removed, the fly assembly may be used as a separate ladder. Rubber end caps 71 are provided at the ends of each side rail 7 of the fly assembly 5. The end caps serve as feet to provide traction when the fly assembly is used as an independent ladder.

On each upper guide bracket sleeve there is mounted a flipper rest 55 on one side of the channel 63 through which the fly assembly moves and a flipper bracket 57 on the opposite side thereof. An arm member or flipper 51 is pivotally mounted to the flipper bracket 57 and the upper guide bracket sleeve 27 by a fastener, illustrated as a single nut and bolt 41 in FIG. 4. Connecting the two flippers 51 is a cross member or handle 53. The cross member 53 includes a bottom web 54 for joining the two flippers 51, and an upstanding web 56 which terminates in an outwardly directed lip 58 to aid in grasping the cross member. The dimension between the upstanding web 56 and the edge of the upper guide bracket sleeve 27 is approximately the same as the opening 63 in the upper guide bracket sleeve. As best viewed in FIG. 3*c*, the amount of support of the rung 9 is determined in part by the width of the bottom web 54. The bottom web 54 may be made wide enough to span the width of opening 63; however, as shown in the drawings, it is sufficient to use a smaller bottom web, so long as the bottom of the rung 9 is supported by the bottom web.

The flipper rests 55 act as supports for the flippers 51 and prevent the flippers from moving downward or being displaced below a preselected support position as shown in FIG. 3*c*. One end of a spring 59 is received in a notch 61 in each flipper. The spring is wrapped around the bolts 41; and the other end of the spring is formed to secure it to the flipper bracket. The handle and the two flippers are securely riveted together and thus act as a single or unitary member. The spring acts to aid gravity in urging or biasing the flipper against the flipper rest.

As can best be seen in FIGS. 2*c* and 3*c*, the handle and two flippers act to prevent the downward movement of a rung on the fly assembly. Preferably, the flippers support the bottom of the rung near each end of the rung, that is, they are each closer to one end of the rung than to the middle. The handle lies between the flippers and beneath the rung. When weight is put on the fly assembly, as when the ladder user climbs on, the handle supports the portion of the bottom of the rung lying between the flippers. Thus, the invention provides a secure means for locking the fly assembly. Since there are several rungs on the fly assembly, the operator can choose an adjustment position at any one of several heights.

The fly assembly can be moved up by pulling the fly assembly up to disengage the run from the locking device. The handle and flippers are then pulled out of the way by pulling back on the top of the handle, thereby moving the locking device out of the vertical plane of movement of the fly assembly. The locking device is then in an accommodating position which leaves a clear channel for the rungs of the fly assembly to move up and down. When the operator releases the handle and flipper, the locking device returns to the preselected support position.

The locking device according to the invention allows the fly assembly to be extended without the operator manipulating the locking device. As best shown in FIGS. 2*a*, 3*a*, 2*b* and 3*b*, as the fly assembly is being raised, the rungs engage the bottom of the flippers. As the fly assembly continues to be raised the flippers are cammed out of the way with their bottoms riding on the top and sides of the rungs. Thus the locking device is put in an accommodating position which allows the extension of the fly assembly. After the rung has passed by the flipper, the springs automatically return the flippers to the preselected support position against the flipper rests. Thus, the springs work as self-acting means for putting the flippers and handle in the proper position for supporting the fly assembly.

As described above, the upper and lower guide bracket sleeves confine the movement of the fly assembly to up and down movement in a vertical plane. Where the flippers are in the preselected support position, the locking device further confines the movement of the fly assembly by preventing downward movement. This is accomplished by placing the locking device transverse to and through the vertical plane of movement. However, up and down movement is allowed when the locking device is repositioned. The repositioning is allowed by pivotally fastening the locking device to the trestle of the ladder on one side of the vertical plane. The locking device may then be pivoted to an accommodating position allowing up and down movement of the fly assembly. Rests are provided on the other side of the vertical plane for supporting the locking device when it returns to the preselected support position.

The locking device according to the invention greatly conveniences the ladder operator because he can raise the fly assembly by simply pulling up or pushing up on the fly assembly. He is not required to manipulate the locking device at all during the extension of the fly assembly. However, the fly assembly is very securely kept from contracting. When the fly assembly is in use, that is, when it must bear the load of a person and/or of equipment like scaffolding, the flippers and the handle provide support under much of the length of the rung, preferably under portions of the rung along at least one half of its length. The fly assembly cannot be unintentionally lowered because the handle must intentionally be pulled back by the ladder operator before the fly assembly can be lowered.

The extension trestle ladder can be fabricated from a variety of materials. For example, a lightweight and inexpensive ladder can be made from wood. A more sturdy, heavy-duty ladder can be made from metal, such as aluminum. In either case the locking device and other hardware is preferably fabricated from sturdy metal such as steel or aluminum. A ladder especially adapted for use in electrical work can be made from fiberglass.

The preferred embodiment disclosed herein fulfills the objects of the invention. There is disclosed a device for securely locking the fly assembly of an extension trestle ladder which is simple to use. The device gives strong support to a fly assembly by supporting a large portion of the cooperating rung. The locking device automatically allows extension of the fly assembly, but prevents accidental contraction of the fly assembly.

The invention has been described with particular reference to the preferred embodiment, but it will be understood that variations and modifications within the spirit and scope of the invention may occur to those skilled in the art to which the invention pertains.

What we claim is:

1. A locking device for locking support of the fly assembly of an extension trestle, in which the trestle is formed with a pair of supporting ladders and a fly assembly, each ladder and fly assembly comprising a pair of opposite side rails and a plurality of rungs or steps, the side rails of said supporting ladders having on the top of each side rail a bracket secured thereto and to the upper rung or step of each said ladder, the free ends of oppositely facing said brackets adapted to project toward each other outwardly of the rail with which it is associated and to overlap, means for hingedly securing said free ends of the brackets together wherefor the opposite side rails of opposite of said supporting ladders are hingedly connected at their upper end portions, opposite spreader means each pivotally secured at its outer ends to brackets secured to a mediate portion of a pair of planar spaced side rails of opposite support ladders, said spreader means each having its opposite ends pivotally secured together by connecting means, oppositely disposed generally U-shaped upper and lower sleeve guide means, the upper guide means being mounted on the means hingedly securing the top brackets together, the lower guide means being secured to the pivotal connection of said spreader means, said upper and lower sleeve guide means being spaced and aligned vertically, said fly assembly being extended or lowered by movement within the aligned sleeve guide means in a generally vertical plane by selective cooperation with a rung of the fly assembly, said device comprising:

Support means for supporting engagement of a selected rung of the fly assembly along at least one-half of the length of said rung.

said support means being pivotally attached to the oppositely disposed upper guide means and being radially displaceable from a peselected support position, wherein the support means is disposed transverse to the plane in which the fly assembly is moveable, to an accomodating position, wherein the support means is disposed proximally away from said plane whereby said fly assembly may be moved within said plane.

2. The locking device of claim 1, wherein said support means comprises a pair of arm members for supporting engagement of said selected rung near the ends thereof, and a cross member joining said arm members for supporting engagement with said rung intermediately at least one-half the length thereof.

3. The locking device of claim 2, wherein said arm members are pivotally attached to the trestle of the ladder on one side of the vertical plane through which the fly assembly moves, and rest means are provided on the other side of the vertical plane for abutment with said arm members when said arm members are in said preselected position.

4. The locking device of claim 2, wherein said cross member includes a bottom web joining said arm members, and an upstanding web transverse to said bottom web, said upstanding web being positioned to allow said selected rung to contact said bottom web when said arm members are in said preselected position.

* * * * *